US009613601B1

(12) United States Patent
Minawi

(10) Patent No.: US 9,613,601 B1
(45) Date of Patent: Apr. 4, 2017

(54) MINAWI STRAW

(71) Applicant: Hasan Ahmad Minawi, Covina, CA (US)

(72) Inventor: Hasan Ahmad Minawi, Covina, CA (US)

( * ) Notice: Subject to any disclaimer, the term of this patent is extended or adjusted under 35 U.S.C. 154(b) by 0 days.

(21) Appl. No.: 14/950,972

(22) Filed: Jan. 11, 2016

(51) Int. Cl.
*G10D 7/02* (2006.01)
*G10D 9/02* (2006.01)

(52) U.S. Cl.
CPC ..... *G10D 7/026* (2013.01); *G10D 9/023* (2013.01)

(58) Field of Classification Search
CPC ..... G10D 7/026; G10D 9/023
See application file for complete search history.

(56) References Cited

U.S. PATENT DOCUMENTS 2,388,822 A * 11/1945 Brilhart ..... G10D 9/023 84/383 A
2,417,480 A * 3/1947 Friedman ..... A23G 3/56 426/104
2,617,324 A * 11/1952 Brody ..... A23G 3/563 426/104
3,415,009 A * 12/1968 Knauf ..... A23G 9/503 426/104
7,825,317 B1 * 11/2010 Lederman ..... G10D 7/00 84/330
7,872,186 B1 * 1/2011 Tatman ..... G10D 7/063 84/380 R

OTHER PUBLICATIONS

Arabs Got Talent with Hasan Minawi, posted to YouTube Apr. 14, 2012.*

* cited by examiner

*Primary Examiner* — Robert W Horn

(57) ABSTRACT

Minawi Straw is invented by a Musician/Music Teacher/Composer Mr. Hasan Ahmad Minawi. It is a unique Musical Instrument, made of simple and inexpensive plastic materials, and it is characterized with a new unique musical sound that has accurate music dimensions according to Music Industry Notes, compatible with other music instruments, as it produces unique different sounds when using a special way of inflation (FIG. 5).

The Minawi Straw is made up of one plastic tube of 19.60 centimeters in length equal to 7.72 inches, and the length can be adjusted longer as needed. It has 8 Sound holes—7 Sound holes on the front side and 1 Sound hole which is Opening 8 on the Upper Rear side (described in the drawing (FIGS. 1 and 2) as openings 1-8). It can be adjusted up to 10 Sound holes, as needed by Player.

1 Claim, 5 Drawing Sheets

FRONT and UPPER REAR SIDE VIEW
OF MINAWI STRAW

TOP VIEW OF MINAWI STRAW

FRONT and UPPER REAR SIDE VIEW
OF MINAWI STRAW

Description of Drawing: RIGHT SIDE VIEW OF MINAW STRAW

LEFT SIDE VIEW OF MINAW STRAW

WHOLE VIEW OF MINAW STRAW – Musical Instrument

MINAWI STRAW

BACKGROUND OF THE INVENTION

Minawi Straw is invented by a Musician/Music Teacher/Composer Mr. Hasan Ahmad Minawi, who has a Master Degree in Music Education. The Inventor Hasan Ahmad Minawi plays many different instruments like Violin, Accordion, Nay, Recorder, Xylophone, and Harmonica. The Inventor is the first musician who developed this newly invented musical instrument out of a straw, and designed it to play World music with the additions of Quarter Tones.

BRIEF SUMMARY OF THE INVENTION

Minawi Straw is a Musical instrument invented by a Musician/Music Teacher/Composer Mr. Hasan Ahmad Minawi. It is a unique Musical Instrument, made of simple and inexpensive plastic materials and it is characterized with a new unique musical sound that has accurate music dimensions, according to Music Industry Notes, compatible with other music instruments, and it produces unique different sounds when using a special way of inflation. The Minawi Straw is endorsed by the written testimony from the Jordan Academy of Music (FIG. 5).

BRIEF DESCRIPTION

The Minawi Straw is made up of one plastic tube of 19.60 centimeters equal to 7.72 inches in length, and the length can be longer adjusted as needed. The mouth piece opening is 1.00 centimeter in width by 0.20.

The Minawi Straw Musical Instrument contains 8 Sound holes (described in drawing as openings) and can extend up to 10 Sound holes as needed. The Inventor drilled the Sound holes according to the musical ladder or the music track to be played and suit the creativity of the instrumentalist as in (FIGS. 1, 2 and 5). It has 8 Sound holes (described in drawings as openings) and they are not equal in size as they are small, medium and large size. On the front side it has 7 Sound holes (openings) and an extra 1 Sound hole on the upper rear side (described in drawings as Opening 8 in FIG. 2), and it can be adjusted to 10 Sound holes, as needed by Player.

A DETAILED DESCRIPTION OF THE INVENTION

FIG. 1 is the Top Side View of Minawi Straw. It shows total length of 19.60 centimeters. There is a curvature of the upper side of the Musical Straw in as much as to allow the recipient of seeing the face of the instrumentalist while playing the Instrument. The upper part of Minawi Straw size is 4.60 centimeter long from the middle stretching section to the mouth opening section, and its length is 15.00 centimeter to the end lower section of the straw. The diameter of the lower section is 0.60 centimeter. It shows 8 Sound holes (described as Openings in drawings and their sizes in detail same as in FIG. 2 description).

FIG. 2 is the Front Side and Upper Rear Side View of Minawi Straw. Like FIG. 1, it shows the length of the Minawi Straw, 15.00+4.60 equals to total 19.60 centimeters. It also shows that the length changes to lower part of 14.92 centimeters and up to 4.61-4.95 centimeters when played as the middle stretching section extends while playing the instrument. It shows the diameter size of the mouth opening of 0.20 centimeter, while as FIG. 1, it shows the diameter size of the lower section is 0.60 centimeter. It shows the size of each Sound hole 1-8 (described as Openings 1-8 in drawings):

Opening 1: 0.40 centimeter,
Opening 2: 0.50 centimeter,
Opening 3: 0.50 centimeter,
Opening 4: 0.60 centimeter,
Opening 5: 0.60 centimeter,
Opening 6: 0.70 centimeter,
Opening 7: 0.50 centimeter, and
Opening 8: 0.30 centimeter (located on other rear side of straw, between opening 1 and 2.

METHOD OF PLAYING MINAWI STRAW

Figure 1:
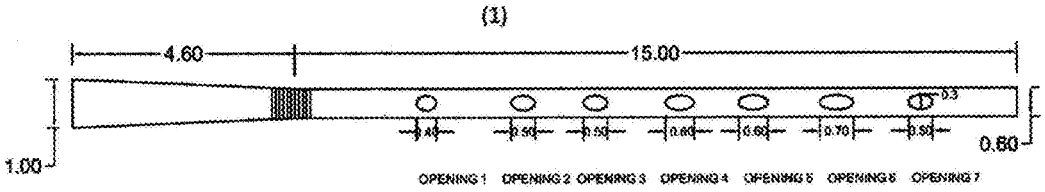
Figure 2:
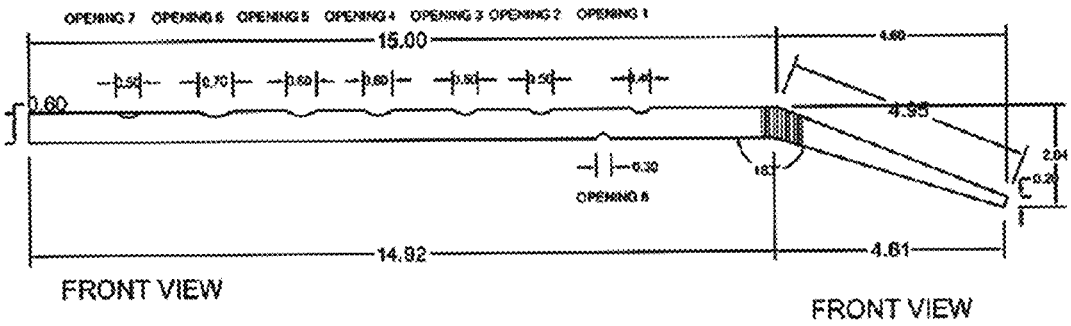
Figure 3:
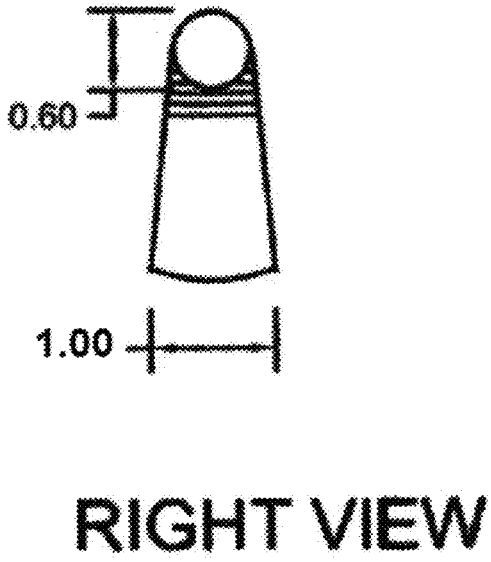
FIG. 3 is the Right Side View of Minawi Straw, shows the mouth piece which is a part of the straw instrument and shows us the method that the instrumentalist is using in order to play a musical sound from the right side. It shows the length of the flexible middle part of straw that extends up to 2.04 centimeters while playing.
Figure 4:
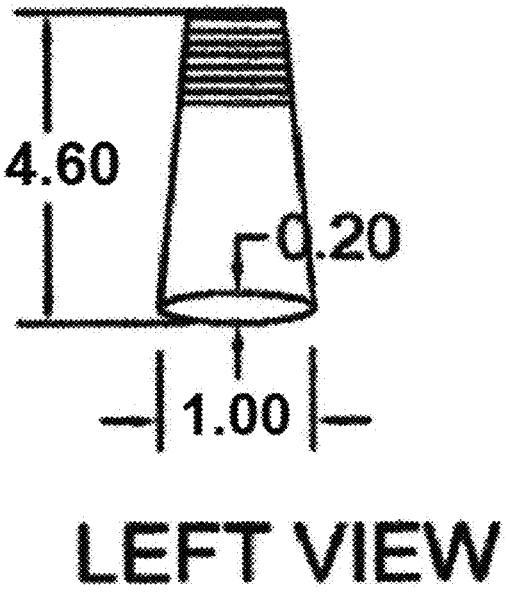
FIG. 4 is the Left Side View of Minawi Straw, shows the upper mouth piece as it shows the method that the instrumentalist is using in order to emit a musical sound from the left side. The diameter size of the upper mouth opening is 1.00 centimeter wide by 0.20 centimeter.
Figure 5:
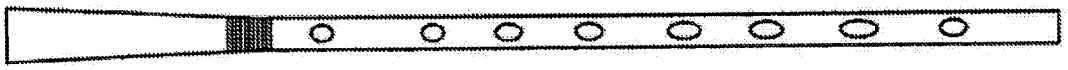
FIG. 5 is an illustration whole view of the patent Minawi Straw.

The instrumentalist enters Minawi Straw, the Musical Instrument Straw, inside the mouth with 2 centimeters distance pushing air strongly where the upper side collide with the lower side of the mouth piece making a vibration which produces the musical sound, and the way of putting the fingers on the aforementioned Straws is sequentially, just like the popular clarinet where it cannot emit any sound if one of the upper fingers is open or loose, the playing process should be constant.

I claim:

1. A wind musical instrument comprising of:

An elongate hollow drinking straw of resilient plastic material defining an air column and comprising of a bending neck portion, as the drinking straw is modified as follows:

The end near the bending portion is flattened to form a double reed that will oscillate when blown;

The part of the straw beyond the bending neck portion is formed with a succession of carefully measured and spaced tone holes;

A bend is placed in the bending neck portion;

Wherein the double reed portion vibrates when the music player blows, and where appropriate when closing and opening of the sound holes while blowing changes the vibrating air column length and the tone played by the instrument.

* * * * *